United States Patent [19]

Ostendorf

[11] 4,313,398

[45] Feb. 2, 1982

[54] STEAM GENERATOR

[75] Inventor: Hermann Ostendorf, Krefeld, Fed. Rep. of Germany

[73] Assignee: Deutsche Babcock Aktiengesellschaft, Oberhausen, Fed. Rep. of Germany

[21] Appl. No.: 87,006

[22] Filed: Oct. 22, 1979

[30] Foreign Application Priority Data

Nov. 22, 1978 [DE] Fed. Rep. of Germany ..... 2850536

[51] Int. Cl.[3] ..... B09B 3/00

[52] U.S. Cl. ..... 122/4 D; 165/104.16

[58] Field of Search ..... 122/4 D; 110/245, 263; 34/57 A; 431/170, 7; 165/104 F

[56] References Cited

U.S. PATENT DOCUMENTS

| | | | |
|---|---|---|---|
| 2,884,373 | 4/1959 | Bailey | 122/4 D |
| 3,914,089 | 10/1975 | Desty et al. | 431/170 X |
| 3,982,901 | 9/1976 | Steener et al. | 122/4 D X |
| 4,148,437 | 4/1979 | Barker et al. | 431/170 X |
| 4,165,040 | 8/1979 | Beacham et al. | 431/170 X |

FOREIGN PATENT DOCUMENTS

| | | | |
|---|---|---|---|
| 7812228 | 6/1979 | Netherlands | 122/4 D |

*Primary Examiner*—Edward G. Favors
*Attorney, Agent, or Firm*—Max Fogiel

[57] ABSTRACT

A steam generator has a combustion chamber through which a bundle of steam-generating tubes extends generally horizontally. Air nozzles extend upwardly through the bottom wall of the steam generator and the spacing between the air outlets and the bundle of steam-generating tubes can be adjusted to thereby vary the level at which the fluidized bed is located within the chamber, and to consequently have the bundle of tubes located completely or only partially within the fluidized bed.

9 Claims, 3 Drawing Figures

STEAM GENERATOR

BACKGROUND OF THE INVENTION

The present invention relates to a steam generator in general, and more particularly to a steam generator of the type in which a bundle of steam-generating tubes extends through a fluidized-bed combustion chamber.

Steam generators having bundles of tubes extend through a combustion chamber in which the tubes are heated, so as to convert water flowing through the tubes into steam, are well known in the prior art (c.f. Chemical Engineers Handbook, 5th Edition, Chapter 11), as are fluidized-bed chambers (Ibid, Chapter 20, pages 64–74). The principle of using a fluidized-bed combustion chamber for steam generation is to obtain as uniform as possible a heat exchange with the tubes and their contents. For this purpose the surface areas in the tube bundle—which is located within the fluidized-bed layer—are so dimensioned that a constant layer temperature is obtained. This is the optimum operating temperature and it is desired to maintain it, even if the equipment operates only at partial capacity. For this purpose, therefore, less heat is withdrawn from the fluidized bed, which can be obtained by lesser cooling of the steam-generating tubes (smaller water flow). A problem with this is that it results in the development of tube-wall temperatures which are impermissibly high for the materials conventionally used for making such tubes.

One solution to the problem, which has been proposed in the prior art, is to make the vertical height of the fluidized-bed variable. The tubing extending into the fluidized-bed is so inclined to the vertical and to the horizontal that the length of the tubing which extends into the fluidized-bed depends upon the height (or depth) of the fluidized-bed. If the depth of the fluidized-bed changes, the thickness and therefore its function are influenced. However, when the equipment operates only at partial capacity it is no longer possible to optimally select the depth of the fluidized-bed, or else the range within regulation of the heat exchange can be effected is very limited.

Another proposal suggests to subdivide the fluidized-bed into several sections, each of which is provided with a heat exchange arrangement. When the equipment is to be operated at partial capacity, some of these sections are then simply not used. However, with this construction the regulation can be effected only by statures, i.e. a continuous adjustment is not possible.

SUMMARY OF THE INVENTION

Accordingly, it is a general object of this invention to avoid the disadvantages of the prior art.

A more particular object is to provide an improved steam generator in which the aforementioned disadvantages are overcome.

A still more particular object is to provide an improved steam generator in which operations can be regulated even when the equipment is only utilized at partial capacity, but such operation is continuously variable and the cooling of the inner wall surfaces of the steam-generating tubes as well as the characteristics of the fluidized-bed layer are maintained at optimum conditions.

Pursuant to the above objects, and to others which will become apparent hereafter, one feature of the invention resides, in a steam generator, in a combination which, briefly stated, comprises means defining a combustion chamber having a bottom wall, a plurality of steam-generating tubes extending through this chamber at a level above the bottom wall, means for admitting particulate combustible material into the chamber, a plurality of air-admitting nozzles extending through the bottom wall and having outlets located above the same so that air admitted through the nozzles causes the particulate combustible material to form a fluidized-bed in the chamber, and adjusting means for adjusting the spacing between the outlets and the tubes, so as to vary the level at which the fluidized bed is located.

By resorting to the construction according to the invention the height of the freeboard, i.e. the space between the bottom wall and the outlets of the nozzles, is changed. Consequently, the height of the inert, thermally insulating layer of ash resting on the bottom wall, is also changed so that the bundle of steam-generating tubes extends to a greater or lesser degree into this stationary insulating layer. Within the insulating layer the steam-generating tubes no longer exchange heat with the fluidized bed, assuming a non-varying degree of cooling of the inner tube surfaces, so that, this measure permits a rather precise and continuous regulation of the amount of heat which is withdrawn by the tubes from the fluidized-bed.

The invention will now be described in more detail with reference to the appended drawings. It should be understood, however, that these drawings merely show exemplary embodiments of the invention and are not considered to be limiting, inasmuch as the scope of protection sought for the invention is defined exclusively in the claims.

DESCRIPTION OF PREFERRED EMBODIMENTS

Figure 1:
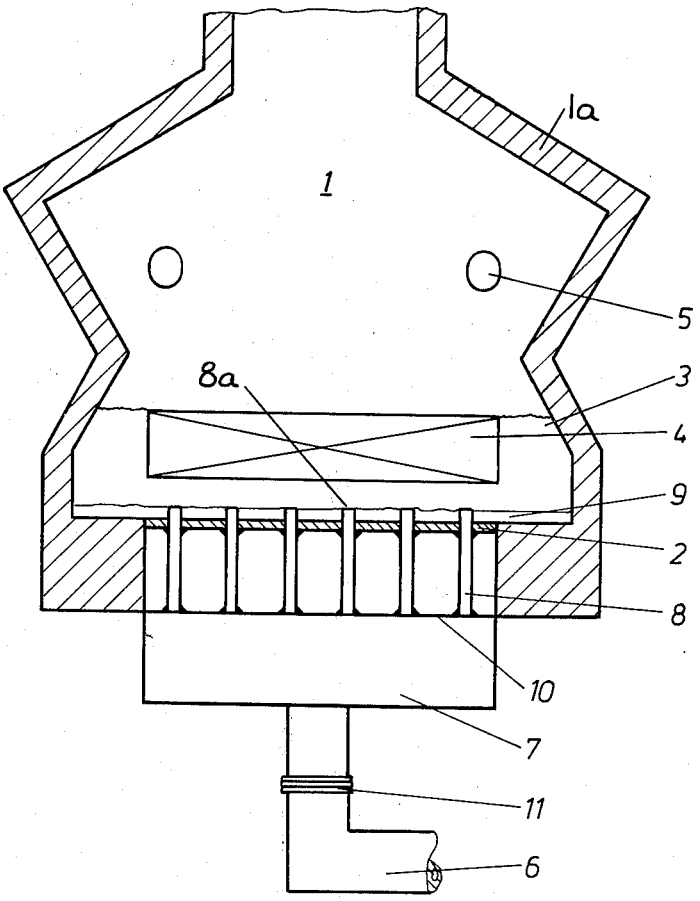
FIG. 1 is a vertical cross-section through a combustion chamber of a steam generator embodying the invention, showing the insulating ash layer to have a low thickness.
Figure 2:
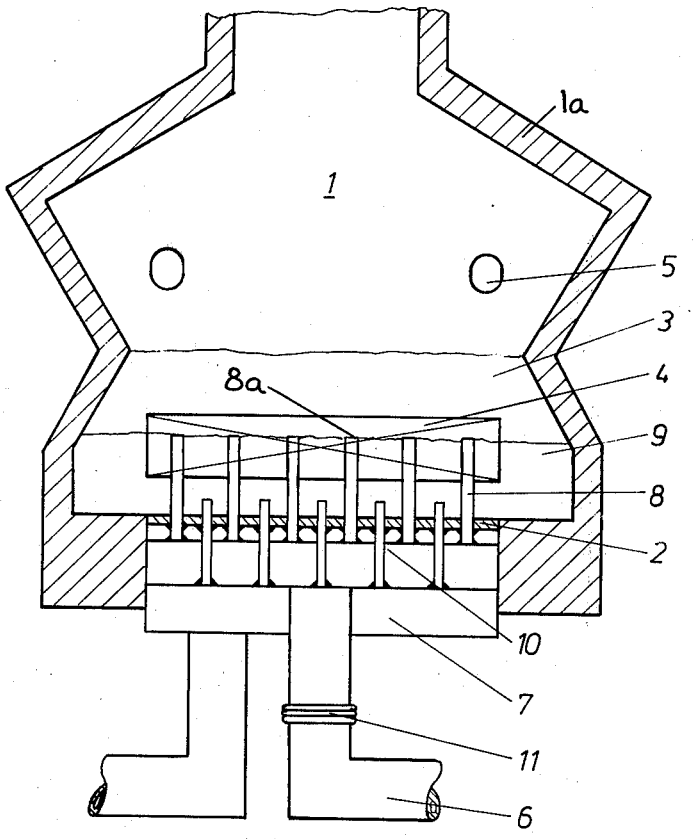
FIG. 2 is a view similar to that in FIG. 1, but showing the thickness of the insulating ash layer increased.

One embodiment of the invention is illustrated in FIGS. 1 and 2 which show a combustion chamber 1 bounded by peripheral walls 1*a* which may or may not be formed by cooled tubes or have cooled tubes embedded in them. The upper part of the combustion chamber, or a combustion-gas flue communicating with the upper end of the combustion chamber may have recuperators (not shown) installed in them.

The bottom wall 2 of the combustion chamber 1 has a plurality of air nozzles 8 extending upwardly through it from below; these nozzles 8 have outlets 8*a* located upwardly spaced from the upper surface of the bottom wall 2, and the distance between this upper surface and the outlets 8*a* is the so-called freeboard. It is in this area that an inert, thermally insulating layer 9 of ash develops. Above this layer 9 a fluidized-bed layer 3 of combustible particulate material is produced and maintained. A bundle of water-circulating steam-generating tubes 4 extends through the combustion chamber, generally within the fluidized-bed layer 3 shown in FIG. 1. No details concerning the tubes 4 are required, because they are known per se from the art.

The combustible material forming the fluidized-bed layer 3 is admitted—if necessary together with a de-sulfurizing substance—through openings 5 in the upper part of the walls 1*a* bounding the combustion chamber 1. Combustion air—which at the same time serves as the fluidizing air—is admitted from a not illustrated source through a pipe 6 into a wind box or plenum chamber 7 located below the bottom wall 2. The lower ends of the nozzles 8, which latter are mounted on the upper wall 10 of the plenum chamber 7, communicate with the interior of the plenum chamber so that air admitted from the pipe 6 enters through the nozzles 8 into the combustion chamber 1, forming at a level above the outlet openings 8*a* the fluidized-bed layer 3. The inert, thermally insulating layer 9 of ash forms in the free-board area and does not participate in the reactions within the fluidized-bed layer 3.

To accommodate the equipment to different load conditions, i.e. to operation at partial capacity, the upper level of the inert stationary layer 9 must be shifted relative to the tube bundle 4. In FIGS. 1 and 2 this is accomplished by having the nozzles 8 securely mounted on (e.g. welded to) the upper wall 10 of the plenum chamber 7 and to have them slidingly extend through corresponding holes in the bottom wall 2. The entire plenum chamber 7 can be raised and lowered by means of an arrangement which is not illustrated in detail because it is known per se from other applications for example by means of a rack on the side wall of the plenum chamber which is for this purpose guided in vertical guides, and a pinion which engages with the rack, or else in any other suitable manner. An elastically expandable connector 11 is interposed in the pipe 6 so as to permit raising and lowering of the plenum chamber 7 without damage to the pipe; the connector 11 may be a bellows of metal or of a synthetic plastic material. Of course, in place of the bellows it is also possible to make the pipe 6 of two telescoped-together sections which form with one another a seal, e.g. a labyrinth seal to prevent the escape of air.

When the plenum chamber 7 is in the position illustrated in FIG. 1 the height of the inert layer 9 is low and the bundle of tubes 4 is completely located within the fluidized-bed layer 3, so that the equipment operates at maximum capacity.

However, the plenum chamber 7 is raised to the position of FIG. 2, then the height of the inert layer 9 increases as shown, and the fluidized-bed layer 3 moves upwardly in the combustion chamber 1; since the bundle of tubes 4 is stationary, it follows that it now becomes immersed to a greater or lesser degree in the layer 9 and to a correspondingly reduced degree in the fluidized-bed layer 3. This, then, corresponds to operation of the equipment at reduced capacity.

It will be appreciated, of course, that the plenum chamber 7 could very well be stationary and that only its upper wall 10 could be raised and lowered, in which case the connector 11 or its equivalent could be omitted.

Figure 3:
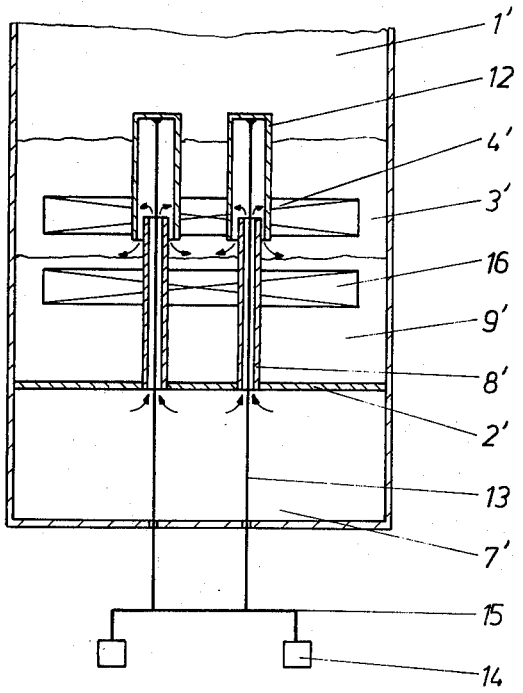
FIG. 3 is a somewhat diagrammatic vertical section through another embodiment of the invention.

In the embodiment of FIG. 3 like reference numerals identify the same components as in FIGS. 1 and 2, except that a prime symbol has been added to them. With this in mind it will be seen that there is again installed a tube bundle 4' in the combustion chamber 1. A bottom wall 2' divides off the lower part of the chamber to form the plenum chamber 7'; it is provided with apertures from which two pair of nozzles 8' extend upwardly into the combustion chamber 1'. Tubular hoods 12 surround the upper ends of the nozzles 8' and their lower end portions define with the upper end portions of these nozzles—which they surround with radial clearance—respective gaps G. It is the lowered end of these gaps G which is generally equivalent to the outlets 8*a* shown in FIGS. 1 and 2.

Each of the nozzles 8' (there can of course be many more than the two illustrated) has a rod extending through it from below; these are identified with reference numeral 13 and their upper ends are connected to the hoods 12 which they thus support whereas their lower ends extend through apertures in the bottom wall of the plenum chamber 7 and are coupled with one or more suitable drives 14. The lower ends of the rods 13 may also be connected with a cross link 15 which in turn is connected to the drives 14, as illustrated in FIG. 3. In any case, the drives 14 (known per se) can raise and lower the rods 13 whereby the hoods 12 are raised and lowered relative to the upper open ends of the nozzles 8', so that the height or vertical level of the gaps G—or rather of the lower ends of these gaps—can be varied. This, then, serves to produce the same effect as in FIGS. 1 and 2, in terms of increasing and decreasing the height of the stationary inert layer 9' and shifting the fluidized-bed layer 3' upwardly or downwardly relative to the tube bundle 4.

It will be appreciated that it is also possible to have linkage 15 located within the plenum chamber 7' itself and to have a single rod extending from it to the drive 14.

According to a further concept of the invention, which, however, is not as effective as those described herebefore, it is possible to arrange the nozzles 8 or 8' in two groups, so that the outlets of one group are located at a first level and the outlets of the second group at a different second level within the fluidized-bed layer. Each of these groups is then supplied with air from a separate plenum chamber and for full-load operation both plenum chambers receive air whereas for a partial-load operation only one of the plenum chambers receives air.

It is furthermore possible to have the nozzles 8 or 8' mounted stationarily, rather than for vertical adjustment, in which case the bundle of steam-generating tubes 4 may be mounted so that it can be moved up or down within the respective combustion chamber. In this case the bundle may be supported on or by a linkage arrangement which extends, e.g. through the bottom wall of the combustion chamber and through the plenum chamber and which can be raised and lowered by a suitable drive. The ends of the tubes of the bundle 4 which extend out of the combustion chamber must then of course be provided with flexible connectors which connect them to stationary tubes located outside the combustion chamber.

FIG. 3 also shows a bundle of anti-overheating tubes 16 which is installed in the combustion chamber 1' so as to be normally located in the fluidized-bed layer 3'. This is necessary if the particulate combustible material to be used in the combustion chamber has a high caloric value, e.g. high-great co with a low moisture content. Of course, the requirement for these tubes 16 is present not only in the embodiment of FIG. 3 but also in that of FIGS. 1 and 2 if such high-quality combustible material is to be burned. The bundle 16 must be located between the bottom wall 2 and the bundle 4 or 4' to avoid problems during starting-up of the installation. During start-up the height of the stationary inert layer 9 must be adjusted sufficiently great—in the manner described before—for the bundle 16 to be completely located within the layer 9. Once the insulation has been started, the height of the layer 9 can then be decreased so that the bundle 16 also becomes wholly or partially located in the fluidized-bed layer 3 and can receive heat-energy from the same.

It is commonly preferred to have the combustion chamber constructed in the manner shown in FIGS. 1 and 2, i.e. to have at least those parts of the combustion chamber walls 1*a* within the confines of which the fluidized-bed layer develops, converge in upward direction. This takes account of the fact that the combustion air admitted through the pipe 8 is also the fluidizing air for the fluidized-bed layer. It must be kept in mind that the fluidizing air is desired always to have a certain constant speed within the fluidized-bed layer. At uniform constant fluidized-bed surface area it is not readily possible to reduce the amount of combustion air admitted (although this is what should happen when the equipment is operated at partial capacity and the amount of combustible material admitted into the chamber is reduced) without also disadvantageously changing the character and operation of the fluidized-bed itself. By the outwardly converging construction of the side walls, the fluidized-bed surface area can be reduced when the outlet openings of the nozzles 8 are located at a high level, i.e. when the equipment operates at reduced capacity. In this manner the quantity of fluidizing air required can be circulated in accordance with the quantity of combustion air which is required to be reduced when the amount of particulate material admitted per unit time is decreased.

Although the invention has been illustrated by way of two exemplary embodiments and by description of some alternatives, it will be understood that other variations are possible and are intended to be encompassed within the scope of the appended claims.

What is claimed is:

1. In a steam generator, a combination comprising means defining a combustion chamber having a bottom wall; a plurality of steam-generating tubes extending through said chamber at a level above said bottom wall; means for admitting particulate combustible marterial into said chamber; a plurality of air-admitting nozzles extending through said bottom wall and having outlets located above the same so that air admitted through said nozzles causes the particulate combustible material to form a fluidized-bed in said chamber; and adjusting means for adjusting the spacing between said outlets and said tubes, so as to vary the level at which said fluidized-bed is located; said tubes being located in said fluidized bed or in an inert bed layer below said fluidized bed dependent on operating capacity.

2. A combination as defined in claim 1, wherein said tubes are mounted for vertical movement in said chamber, and said adjusting means is operative to effect such vertical movement.

3. A combination as defined in claim 1, said bottom wall having holes and said nozzles extending slidably through said holes; further comprising an air box beneath said bottom wall and having an interior communicating with said nozzles and an upper side provided with a cover plate; and for insert adjusting means are operative for vertically displacing at least one of said air box and cover plate.

4. A combination as defined in claim 1, said nozzles each having an upper end and a hood surrounding said upper end with clearance and defining therewith the respective outlet; and wherein said adjusting means is operative for raising and lowering said hoods relative to said nozzles.

5. A combination as defined in claim 1, said nozzles forming two groups each having the outlets thereof located at a level different from the outlets of the other group; and further comprising means for admitting air through the nozzles of each group separately from the nozzles of the other group.

6. A combination as defined in claim 1, said combustion chamber having parts of sidewalls with a cross-section which tapers substantially conically in upward direction over at least part of the chamber height; said parts of said sidewalls surrounding said fluidized bed.

7. A combination as defined in claim 1, and further comprising a plurality of anti-overheating pipes extending through said combustion chamber intermediate said steam-generating tubes and said bottom wall.

8. A combination as defined in claim 1, said nozzles being vertically slidable in holes of said bottom wall; further comprising an air box beneath said bottom wall, connected to said nozzles and communicating with the interior thereof, said adjusting means being operative for vertically moving said air box; a fixed air supply tube; and yieldable means connecting said air supply tube with said air box to permit movement of the air box relative to the air supply tube.

9. A combination as defined in claim 4, said adjusting means comprising vertically movable rods each extending through one of said nozzles and connected to the interior of the respectively associated hood for raising and lowering the same.

* * * * *